US011705027B2

(12) United States Patent
Tang

(10) Patent No.: US 11,705,027 B2
(45) Date of Patent: Jul. 18, 2023

(54) METHOD FOR DETECTING GATE LINE DEFECTS, DISPLAY PANEL AND READABLE STORAGE MEDIUM

(71) Applicants: BEIHAI HKC OPTOELECTRONICS TECHNOLOGY CO., LTD., Beihai (CN); CHONGQING HKC OPTOELECTRONICS TECHNOLOGY CO., LTD., Chongqing (CN)

(72) Inventor: Li Tang, Beihai (CN)

(73) Assignees: BEIHAI HKC OPTOELECTRONICS TECHNOLOGY CO., LTD., Beihai (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 160 days.

(21) Appl. No.: 17/332,006

(22) Filed: May 27, 2021

(65) Prior Publication Data

US 2021/0287580 A1 Sep. 16, 2021

Related U.S. Application Data

(63) Continuation of application No. PCT/CN2020/095511, filed on Jun. 11, 2020.

(30) Foreign Application Priority Data

Jun. 12, 2019 (CN) ..... 201910505510.7

(51) Int. Cl.
*G09G 3/20* (2006.01)
*G09G 3/00* (2006.01)

(52) U.S. Cl.
CPC ..... *G09G 3/006* (2013.01); *G09G 3/20* (2013.01); *G09G 2310/0267* (2013.01); *G09G 2310/08* (2013.01)

(58) Field of Classification Search
USPC ..... 345/208
See application file for complete search history.

(56) References Cited

U.S. PATENT DOCUMENTS

| | | | | |
|---|---|---|---|---|
| 10,269,316 | B2 | 4/2019 | Sakurai | |
| 2008/0036715 | A1* | 2/2008 | Lee | G09G 3/3648 345/87 |
| 2020/0193882 | A1* | 6/2020 | Tamano | G02F 1/13 |

FOREIGN PATENT DOCUMENTS

| | | | |
|---|---|---|---|
| CN | 101719352 | A | 6/2010 |
| CN | 101958091 | A | 1/2011 |

(Continued)

OTHER PUBLICATIONS

First Office Action issued in counterpart Chinese Patent Application No. 201910505510.7, dated Mar. 3, 2021.

(Continued)

*Primary Examiner* — Ifedayo B Iluyomade
(74) *Attorney, Agent, or Firm* — Westbridge IP LLC

(57) ABSTRACT

The application discloses a method for detecting gate line defects, a display panel and a readable storage medium. The method for detecting gate line defects includes the following operations: controlling a display panel to enter a self-checking mode upon receiving a startup signal; performing row scanning on the display panel according to a first preset frame rate, where the first preset frame rate is greater than a normal frame rate when the display panel normally operates; and upon determining that the display panel is abnormal, issuing a prompt message.

19 Claims, 5 Drawing Sheets

(56) References Cited

FOREIGN PATENT DOCUMENTS

| | | | | | |
|---|---|---|---|---|---|
| CN | 102158527 | A | | 8/2011 | |
| CN | 102184695 | A | | 9/2011 | |
| CN | 103426383 | A | | 12/2013 | |
| CN | 103630832 | A | | 3/2014 | |
| CN | 105185346 | A | | 12/2015 | |
| CN | 105551413 | A | | 5/2016 | |
| CN | 108873525 | A | | 11/2018 | |
| CN | 109243347 | A | | 1/2019 | |
| CN | 109584760 | A | | 4/2019 | |
| CN | 109584762 | A | | 4/2019 | |
| CN | 110288931 | A | | 9/2019 | |
| EP | 0843300 | B1 | | 11/2008 | |
| JP | H09292428 | A | | 11/1997 | |
| JP | WO2019050020 | | * | 3/2019 | ..... G02F 1/13 |
| KR | 20080012512 | A | | 2/2008 | |

OTHER PUBLICATIONS

International Search Report and Written Opinion issued in corresponding PCT Application No. PCT/CN2020/095511, dated Sep. 16, 2020.

* cited by examiner

METHOD FOR DETECTING GATE LINE DEFECTS, DISPLAY PANEL AND READABLE STORAGE MEDIUM

CROSS-REFERENCE TO RELATED APPLICATIONS

This application is a continuation application of PCT application No. PCT/CN2020/095511 filed on Jun. 11, 2020, which claims priority to Chinese Patent Application No. 201910505510.7, filed in the China Patent Office on Jun. 12, 2019, and titled "Method for Detecting Gate Line Defects, Display Panel and Readable Storage Medium". The disclosures of the aforementioned applications are hereby incorporated by reference in their entireties.

TECHNICAL FIELD

The application relates to the technical field of display, in particular to a method for detecting gate line defects, a display panel and a readable storage medium.

BACKGROUND

The statement herein only provides background information related to this application and does not necessarily constitute prior art.

In the process of pressing the source driver to the bonded region of the array substrate or pressing the source driver to the printed circuit board, the pressing machine may crush the pin of the source driver configured to be bonded and/or the gate line to which the pin is bound. This results in a decrease in the conductive cross-section of the gate line, and the gate line has a larger resistance as compared with other normal gate lines. The display panel has crushed gate lines displays normally at the initial stage, but will become abnormally in display later. For example, the thin film transistor of the corresponding row of the crushed gate lines cannot be turned on, which leads to the user finding the problem and repairing the display panel after the display panel leaving the factory, and brings inconvenience to the user.

SUMMARY

The main objective of this application is to provide a method for detecting gate line defects, a display panel and a readable storage medium.

In accordance with one aspect of this application, a method for detecting gate line defects is provided and includes:

- upon receiving a startup signal, controlling a display panel to enter a self-checking mode;
- performing row scanning on the display panel according to a first preset frame rate, wherein the first preset frame rate is greater than a normal frame rate when the display panel works normally; and
- upon determining that the display panel is abnormal, issuing a prompt message.

In accordance with another aspect of this application, a display panel is provided and includes a memory, a main control circuit board, and a gate line defect detection program stored in the memory and executable by the main control circuit board, when the gate line defect detection program is executed by the main control circuit board, the operations of the method for detecting gate line defects according to any one of the above described are realized.

In accordance with still another aspect of this application, a computer readable storage medium is still provided, on which a control program of a method for detecting gate line defects is stored, when the control program of the method for detecting gate line defects is executed by a main control circuit board, operations of the method for detecting gate line defects according to any one of the above described are realized.

As a result of receiving a startup signal, and controlling the display panel to enter the self-checking mode, the display panel is scanned row by row according to a first preset frame rate. The first preset frame rate is larger than a normal frame rate that the display panel works normally, a scanning time of each gate line is shortened, that is, a charging time of each TFT (Thin Film Transistor) is shortened. During the charging time, the TFT is not turned on, and/or, the TFT is turned on after a delay. The TFTs of a corresponding row of a crushed gate line cannot reach a target charging voltage, which causes the display panel to display abnormally, so that the crushed gate line is foregrounded, and the crushed gate line can be observed. When the display panel is detected to display abnormally, a prompt message is sent out to prompt a maintenance person to carry out maintenance, thus avoiding returning the display panel to the factory for maintenance in the later.

Figure 1:
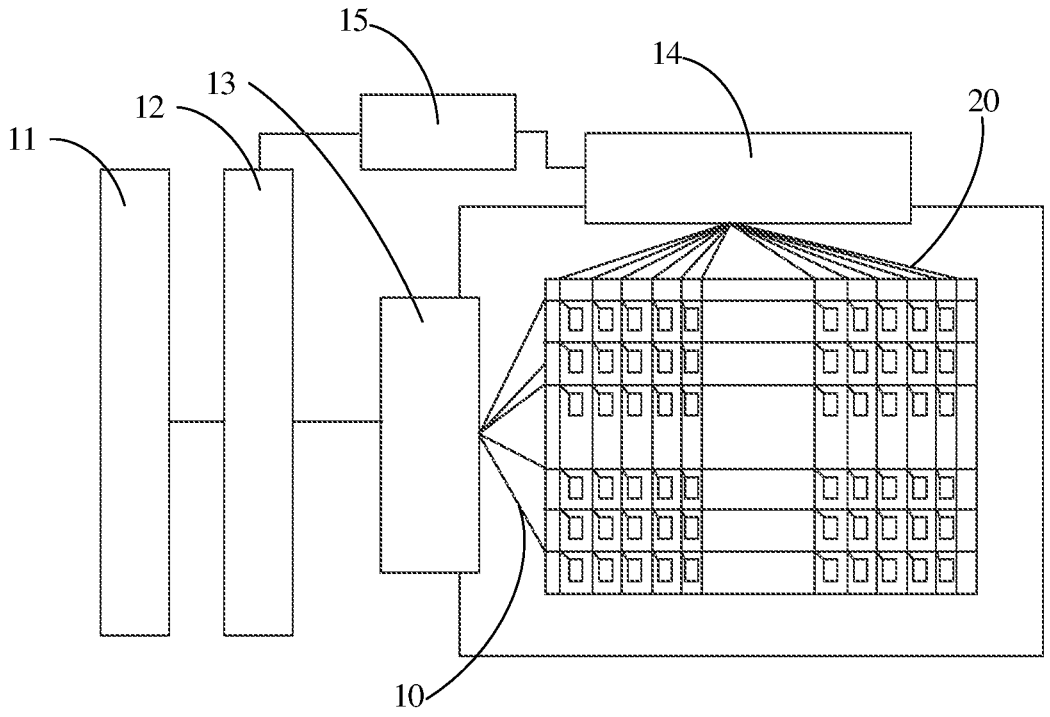
FIG. 1 is a schematic structural diagram of a display panel to which a method for detecting gate line defects of this application is apply.

The realization, functional features and advantages of this application will be further explained in connection with embodiments and with reference to the accompanying drawings.

DETAILED DESCRIPTION OF THE EMBODIMENTS

A clear and complete description of the technical solution of the embodiments of this application will be made in connection with the accompany drawings. Apparently, the described embodiments are only part and not all of the embodiments of this application. Based on the embodiments in this application, all other embodiments obtained by those of ordinary skill in the art without creative work fall within the claimed scope of this application.

It should be noted that all directional indications (such as top, bottom, left, right, front, rear, etc.) in embodiments of this application are only used to explain the relative positional relationships, motion situations, etc. between components under a specific posture (as shown in the drawings). If the specific posture changes, the directional indications also change accordingly.

In addition, the descriptions of "first", "second" and the like in this application are used for descriptive purposes only and cannot be construed as indicating or implying relative importance of indicated technical features or implying the number of the indicated technical features. Thus, features defined by "first" and "second" may explicitly or implicitly include at least one of the features. In addition, the technical solutions between various embodiments can be combined with each other, but must be based on the ability of one of ordinary skill in the art to realize, and when a combination of technical solutions is inconsistent or cannot be realized, it should be considered that such combination of the technical solutions does not exist and is not within the claimed scope of this application.

Referring to FIG. 1, FIG. 1 is a schematic structural diagram of a display panel to which a method for detecting gate line defects of this application is applied. The display panel 10 includes: a main board circuit 11 connected to a timing controller 12, a gate driver 13 connected to the timing controller 12 and a plurality of gate lines 20. A source driver 14 connected to the timing controller 12 and a plurality of first data lines 30, and a gamma circuit 15 connected between the timing controller 42 and the source driver 14.

Based on the above display panel, the method for detecting gate line defects of this application is proposed. A solution of an embodiment of this application is:

upon receiving a startup signal, controlling the display panel to enter a self-checking mode;

performing row scanning on the display panel according to a first preset frame rate, where the first preset frame rate is greater than a normal frame rate when the display panel works normally; and issuing a prompt message upon confirming that the display panel is abnormal.

At present, display panels cannot be checked to find defective gate lines before leaving the factory, resulting that the display panels are returned to the factory for maintenance in the later.

As a result of receiving a startup signal and controlling the display panel to enter the self-checking mode, the display panel is scanned row by row according to a first preset frame rate. The first preset frame rate is larger than a normal frame rate that the display panel works normally, a scanning time of each gate line is shortened, that is, a charging time of each TFT (Thin Film Transistor) is shortened. During the charging time, the TFT is not turned on, and/or, the TFT is turned on after a delay. The TFTs of a corresponding row of a crushed gate line cannot reach a target charging voltage, and causes the display panel to display abnormally, so that the crushed gate line is foregrounded, and the crushed gate line can be observed. When the display panel is detected to display abnormally, a prompt message is sent out to prompt a maintenance person to carry out maintenance, thus avoiding returning the display panel to the factory for maintenance in the later.

Figure 2:
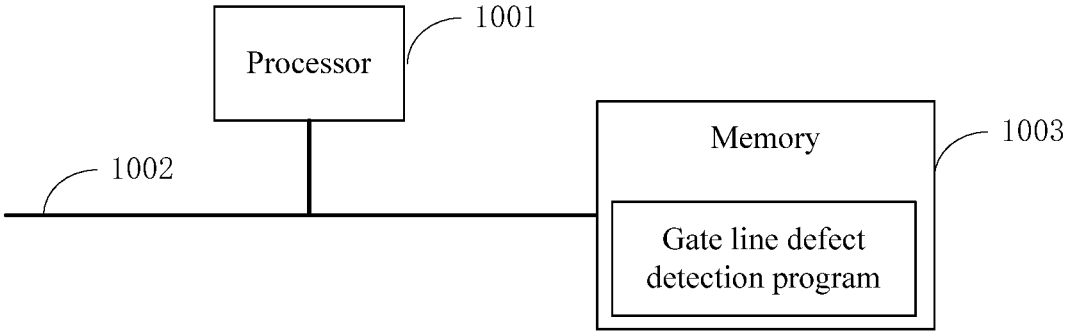
FIG. 2 is a schematic structural diagram of a terminal of a hardware operating environment related to embodiments of this application.

As shown in FIG. 2, FIG. 2 is a schematic structural diagram of a terminal of a hardware operating environment related to embodiments of this application.

The terminal of the embodiments of this application can be a display panel of a PC, a smart phone, a tablet computer, a portable computer, or the like.

As shown in FIG. 1, the terminal may include a processor 1001 (e.g., a main control circuit board), a memory 1003, and a communication bus 1002. The communication bus 1002 is configured to enable connection and communication between those components. The memory 1003 may be a high-speed RAM memory or a non-volatile memory, such as a magnetic disk memory. The memory 1003 may optionally be a storage device independent of the aforementioned processor 1001.

As will be appreciated by those skilled in that art, the structure of the terminal illustrated in FIG. 1 does not constitute a limitation of the terminal which may include more or fewer components than shown, or a combination of certain components, or different component arrangements.

As shown in FIG. 2, a memory 1003, as a computer storage medium, may include a gate line defect detection program.

In the display panel shown in FIG. 2, the processor 1001 can be configured to invoke the gate defect detection program stored in the memory 1003 and perform the following operations:

upon receiving the startup signal, controlling the display panel to enter a self-checking mode;

performing row scanning on the display panel according to a first preset frame rate, where the first preset frame rate is greater than a normal frame rate when the display panel works normally;

upon determining that the display panel is abnormal, issuing a prompt message.

Further, the processor 1001 can invoke the gate line defect detection program stored in the memory 1003 and also perform the following operations:

controlling the display panel to close a self-checking interface and exit the self-checking mode.

Further, the processor 1001 can invoke the gate line defect detection program stored in the memory 1003 and also perform the following operations:

upon determining that the display panel displays normally, controlling the display panel to normally start up; and controlling the display panel to perform row scanning according to the normal frame rate.

Further, the processor 1001 can invoke the gate line defect detection program stored in the memory 1003 and also perform the following operations:

upon determining that the display panel displays normally, controlling the display panel to enter the self-checking mode again, and performing row scanning on the display panel according to a second preset frame rate, where the second preset frame rate is greater than the first preset frame rate; and upon determining that the display panel displays abnormally, issuing a prompt message and controlling the display panel to close the self-checking interface and exit the self-checking mode.

Further, the processor 1001 can invoke the gate line defect detection program stored in the memory 1003 and also perform the following operations:

modifying a current pixel clock frequency of a main control circuit board;

obtaining the first preset frame rate according to the modified pixel clock frequency; and setting a frame rate of a timing controller to be the first preset frame rate.

Further, the processor 1001 can invoke the gate line defect detection program stored in the memory 1003 and also perform the following operations:

controlling the timing controller to perform row scanning on a plurality of gate lines in the display panel through a gate driver according to the first preset frame rate.

Further, the processor 1001 can invoke the gate line defect detection program stored in the memory 1003 and also perform the following operations:

during performing the row scanning on the display panel according to the first preset frame rate, controlling the timing controller to output data signals to a plurality of data lines of the display panel through a source driver to charge TFTs of the display panel.

Figure 3:
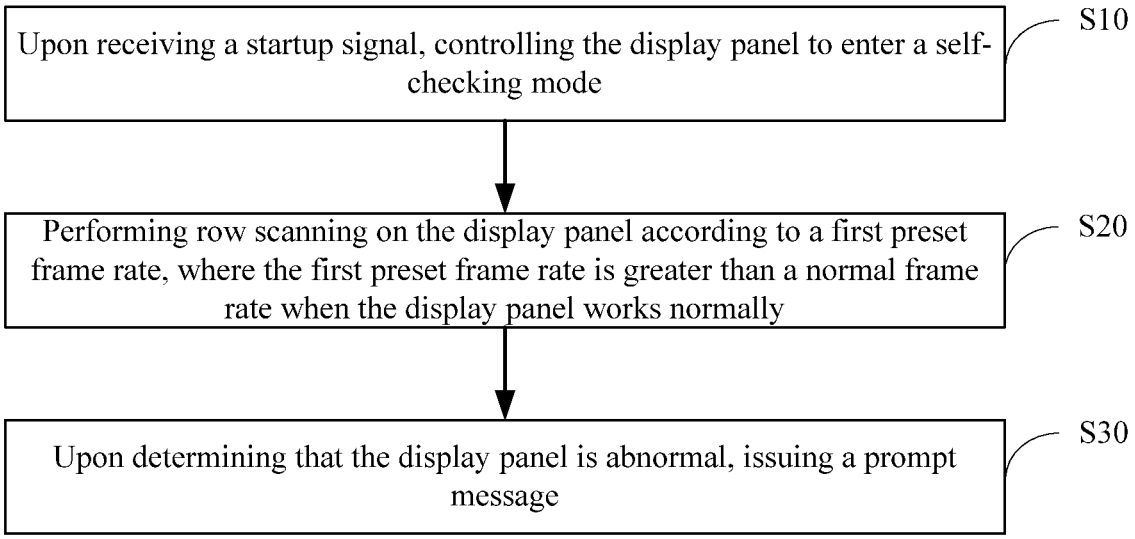
FIG. 3 is a flow diagram of an embodiment of the method for detecting gate line defects of this application.

Referring to FIG. 3, in one embodiment, this application provides a method for detecting gate line defects, the method including the following operations.

Operation S10, upon receiving a startup signal, controlling the display panel to enter a self-checking mode.

In this embodiment, the startup signal can be sent by an infrared remote controller, an intelligent terminal communicated with the display panel, or a startup button set on the display panel and triggered. Each time the display panel receives the startup start signal, it will enter the self-checking mode first. Only that the display panel passes self-checking, will the display panel be controlled to start normally.

Operation S20, performing row scanning on the display panel according to a first preset frame rate, where the first preset frame rate is greater than a normal frame rate when the display panel works normally.

In this embodiment, a HD (high definition) display panel with a resolution of 1366*768 is taken as an example, the HD display panel has 1026 data signal input channels according to manufacturing standards. That is, 1026 data lines configured to transmit data signals are provided on the display panel. At the same time, 768 gate lines are arranged on the display panel. If a normal frame rate of the HD display panel is 60 frames per second when the HD display panel normally operates. That is, a refresh time of each frame animation on the display panel is 1/60 second, in 1/60 second, the 768 gate lines are scanned row by row, that is, the 768 gate lines are controlled to be turned on row by row, and arrayed TFTs in the display panel are charged through the 1026 data lines, then a charging time of each TFT is equal to the time that a row of TFTs are turned on by a gate line, and the charging time is equal to 1/60 second divided by 768.

In this embodiment, each display panel has a determined normal frame rate for normal operation after completion of manufacturing, and the first preset frame rate is greater than the normal frame rate for normal operation of the display panel. If the normal frame rate of the display panel is 60 frames per second, the first preset frame rate is greater than 60 frames per second. When the display panel enters the self-checking mode, row scanning is performed on the display panel based on the first preset frame rate such as 70 frames per second. The first preset frame rate is larger than the normal frame rate: 60 frames per second when the display panel is normally working. The charging time of the corresponding TFT becomes 1/70 second divided by 768 and is less than the charging time when the display panel is normally working. In addition, a crushed gate line in the display panel has a small conductive cross section, during the charging time, the TFT is not turned on, or the TFT is delayed to be turned on. The TFT of the row corresponding to the crushed gate line cannot reach a target charging voltage during an conducting time, and causes the display panel to display abnormally, for example, the display panel displays black lines or black areas. At this time, since the crushed gate line appears prominently, the crushed gate line can be observed.

Operation S30, upon determining that the display panel is abnormal, issuing a prompt message.

In this embodiment, if the display panel is abnormal, a prompt message is sent out in time, and the prompt message can be a prompt such as "poor display" or "poor gate line" displayed on the display panel, so as to perform repairment before the display panel leaves the factory, and avoid the repairment caused by defective gate line phenomenon during use of the user in the later.

In summary, as a result of receiving a startup signal, and controlling the display panel to enter the self-checking mode, the display panel is scanned row by row according to a first preset frame rate. The first preset frame rate is larger than a normal frame rate that the display panel works normally, a scanning time of each gate line is shortened, that is, a charging time of each TFT (Thin Film Transistor) is shortened. During the charging time, the TFT is not turned on, and/or, the TFT is turned on after a delay. The TFTs of a corresponding row of a crushed gate line cannot reach a target charging voltage, and causes the display panel to display abnormally, so that the crushed gate line is foregrounded, and the crushed gate line can be observed. When the display panel is detected to display abnormally, a prompt message is sent out to prompt a maintenance person to carry out maintenance, thus avoiding returning the display panel to the factory for maintenance in the later.

In an alternative embodiment, the prompt message includes a row number of a row where the abnormal gate line is located, so as to prompt the maintenance person with the specific maintenance position and facilitate the maintenance person to carry out maintenance.

Figure 4:
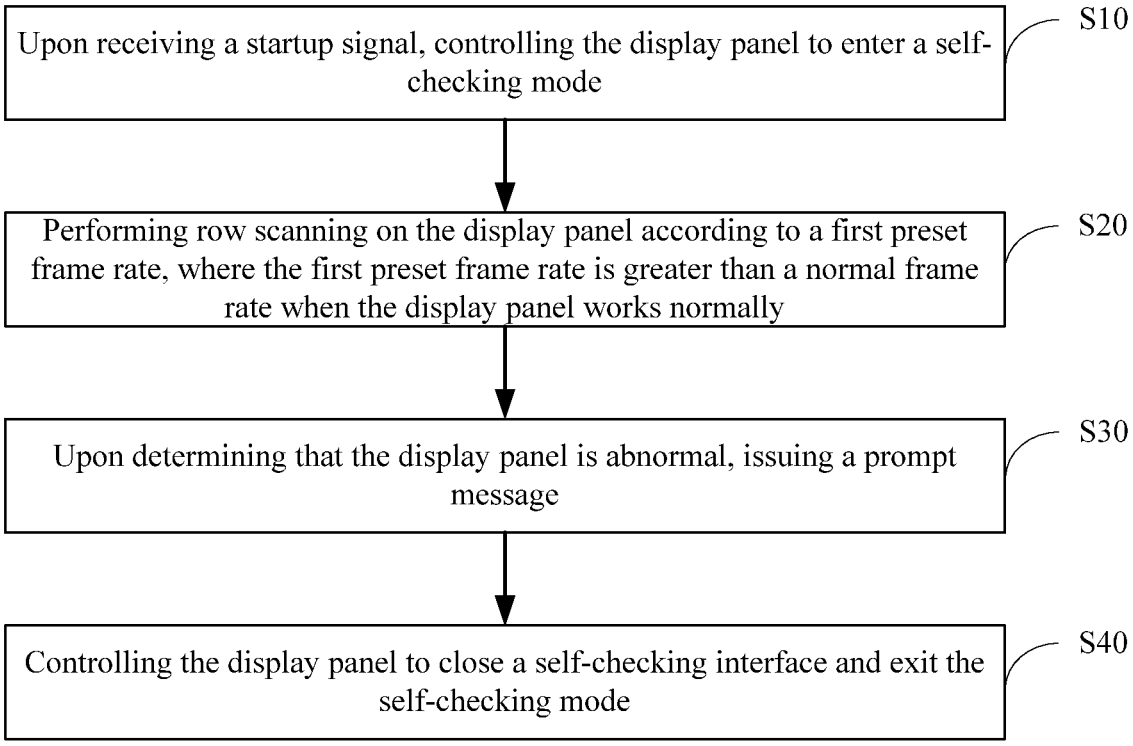
FIG. 4 is a flow diagram of another embodiment of the method for detecting gate line defects of this application.

Referring to FIG. 4, in an alternative embodiment, operation S30 is followed by:

Operation S40, controlling the display panel to close a self-checking interface and exit the self-checking mode.

In this embodiment, after the display panel displays abnormally and sends out the prompt message, the display panel is controlled to close a self-checking interface and exit the self-checking mode to save energy consumption.

Figure 5:
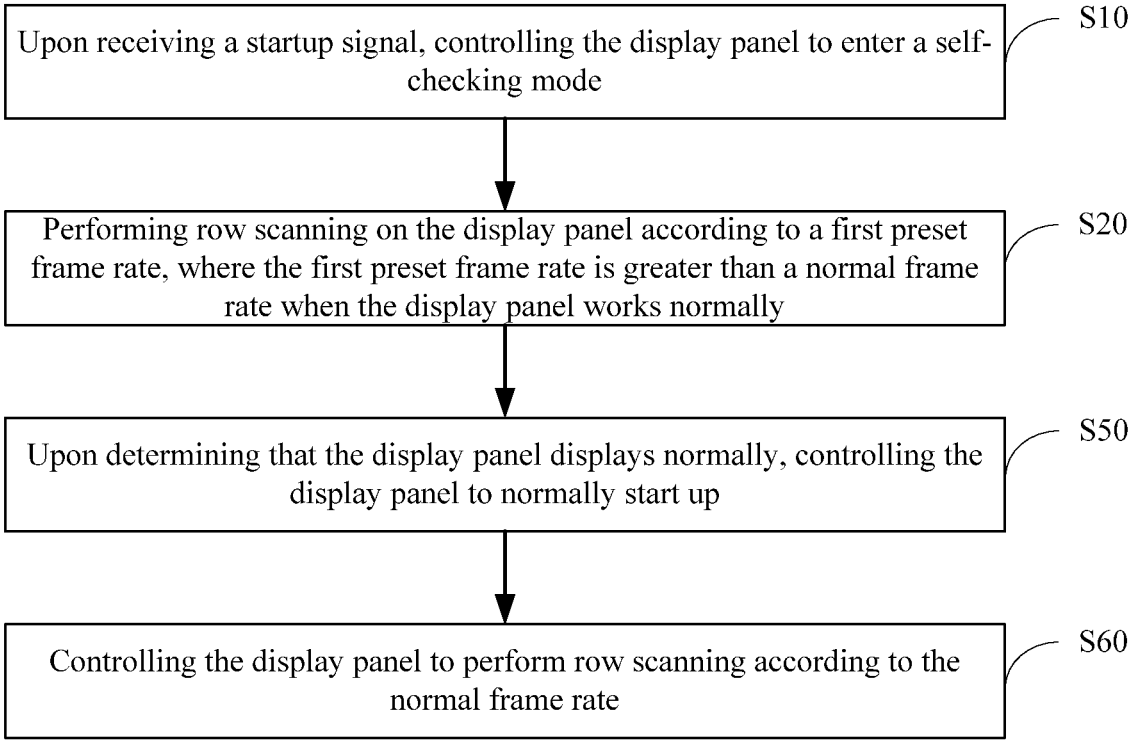
FIG. 5 is a flow diagram of still another embodiment of the method for detecting gate line defects of this application.

Referring to FIG. 5, in an alternative embodiment, operation S20 is followed by:

Operation S50, upon determining that the display panel displays normally, controlling the display panel to normally start up; and Operation S60, controlling the display panel to perform row scanning according to the normal frame rate.

In this embodiment, after determining that the display panel displays normally, the display panel is controlled to be normally turned on, and the display panel is controlled to perform row scanning according to the normal frame rate, so as to realize the normal display function of the display panel, and is also convenient to observe the performance of the display panel during normal operation.

Figure 6:
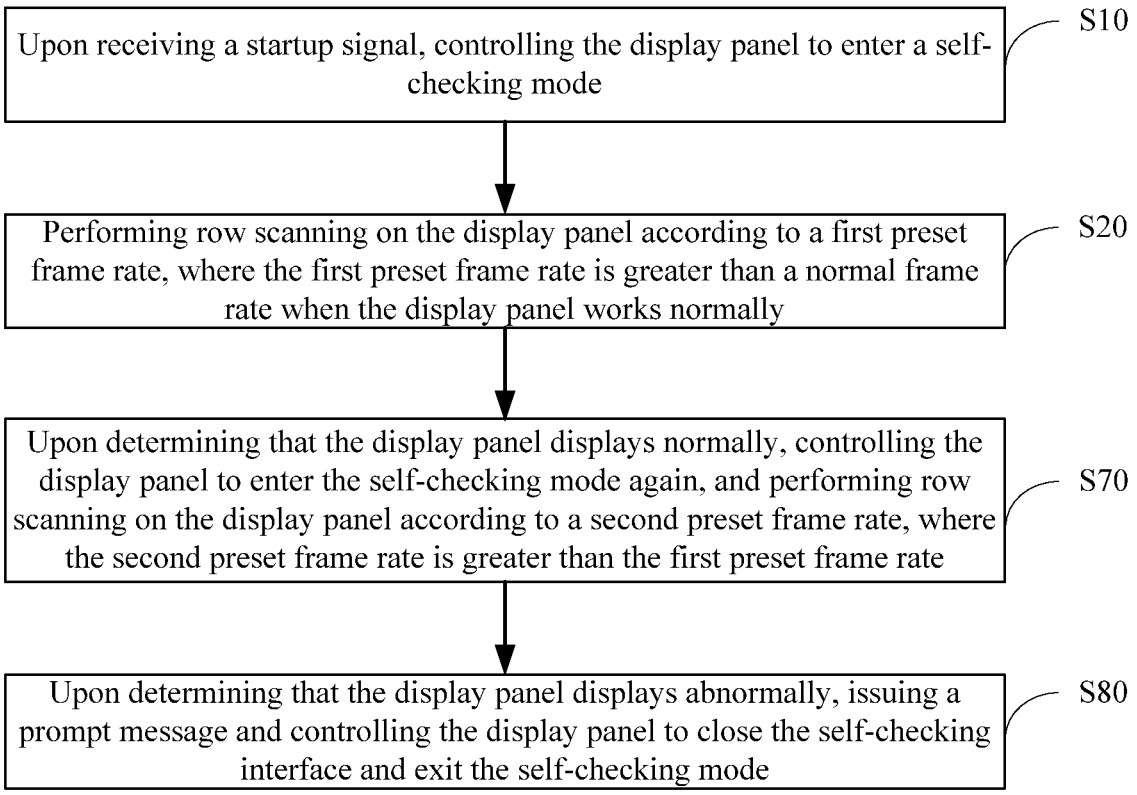
FIG. 6 is a flow diagram of still another embodiment of the method for detecting gate line defects of this application.

Referring to FIG. 6, in an alternative embodiment, operation S20 is followed by:

Operation S70, upon determining that the display panel displays normally, controlling the display panel to enter the self-checking mode again, and performing row scanning on the display panel according to a second preset frame rate, where the second preset frame rate is greater than the first preset frame rate; and Operation S80, upon determining that the display panel displays abnormally, issuing a prompt message and controlling the display panel to close the self-checking interface and exit the self-checking mode.

In this embodiment, the second preset frame rate is a frame frequency greater than the first preset frame frequency after the first preset frame rate in the aforementioned scheme is determined. After the display is scanned row by row at the first preset frame rate such as 70 frames per second, and if the display panel is normal, the display panel is controlled to enter the self-checking mode again, and the display panel is scanned row by row according to a second preset frame rate, which may be 80 frames per second for example, and is larger than the first preset frame rate. At this time, a time for supplying a turn-on voltage to each gate line becomes less, and it is easier to detect the crushed gate line for maintenance.

Figure 7:
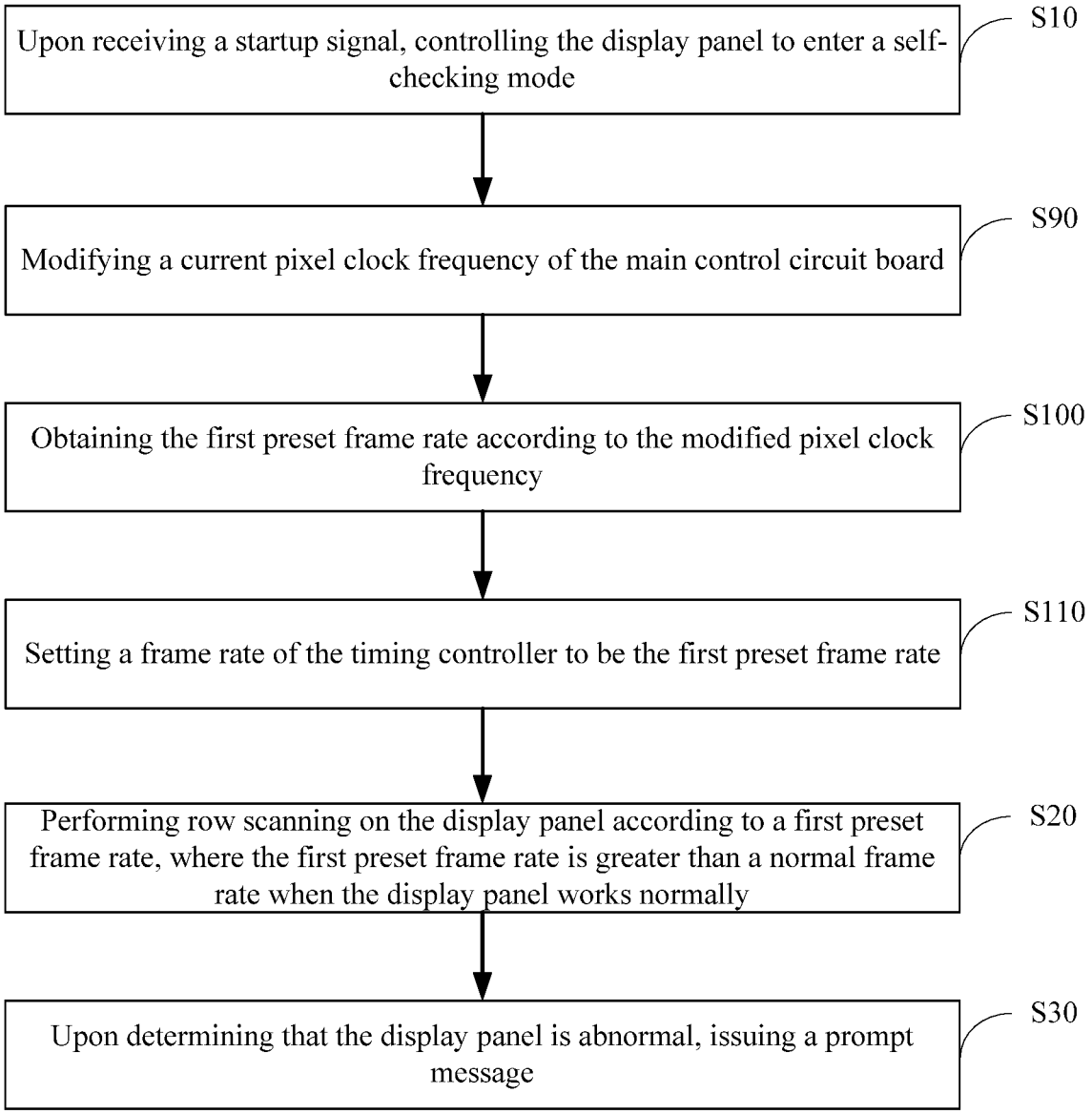
FIG. 7 is a flow diagram of still another embodiment of the method for detecting gate line defects of this application.

Referring to FIG. 7, in an alternative embodiment, the display panel includes a main control circuit board and a timing controller, the operation S20 being preceded by:

Operation S90, modifying a current pixel clock frequency of the main control circuit board;

Operation S100, obtaining the first preset frame rate according to the modified pixel clock frequency; and Operation S110, setting a frame rate of the timing controller to be the first preset frame rate.

In this embodiment, by modifying a current pixel clock frequency of a main control circuit board, calculating the first preset frame rate according to the pixel clock frequency, and setting a frame rate of a timing controller to be the first preset frame rate, the timing controller performs row scanning on gate lines according to the first preset frame rate, and detects the crushed gate line.

In an alternative embodiment, the display panel further includes a gate driver connected to a plurality of gate lines, the operation S20 including:

Operation S21, controlling the timing controller to perform row scanning on the plurality of gate lines in the display panel through the gate driver according to the first preset frame rate.

In this embodiment, the timing controller sends a scanning signal to a gate driver, which sends the scanning signal row by row to gates of TFTs to turn on the TFTs row by row.

In an alternative embodiment, the display panel further includes a source driver, a plurality of data lines and a plurality of TFTs, wherein the source driver is connected with the timing controller and the plurality of data lines, gates of the TFTs are connected with the gate lines, sources of the TFTs are connected with the data lines, and the method for detecting gate line defects further includes:

Operation S120, during performing the row scanning on the display panel according to the first preset frame rate, controlling the timing controller to output data signals to the plurality of data lines of the display panel through the source driver to charge the TFTs of the display panel.

In this embodiment, the above-mentioned HD display panel with the resolution of 1366*768 is taken as an example, the HD display panel has 1026 data signal input channels according to existing manufacturing standards, the display panel is also provided with 1026 data lines configured to transmit data signals. As that gate line are turned on row by row, the arrayed TFTs in the display panel are charged through the 1026 data lines. As that frame rate is increased, the charging time of the TFTs is less than the charging time during the normal operation of the display panel. In addition, a crushed gate line in the display panel has a small conductive cross section. In a shorter charging time, the TFTs is not turned on, and/or, the TFTs is delayed to be turned on, and the TFTs of a row corresponding to the crushed gate line cannot reach the target charging voltage, and causes the display panel to display abnormally, for example, the display panel displays black lines or black areas. At this time, the crushed gate line appears prominently, and the crushed gate line can be observed.

In addition, in order to achieve the above objectives, this application also provides a display panel. The display panel includes a memory, a main control circuit board, and a gate line defect detection program stored in the memory and executable by the main control circuit board. When the gate line defect detection program is executed by the main control circuit board, operations of realizing a method for detecting gate line defects described above are implemented.

In addition, in order to achieve the above object, this application also provides a computer readable storage medium on which a control program of a method for detecting gate line defects is stored, and operations of realizing a method for detecting gate line defects described above are implemented when the control program of the method for detecting gate line defects is executed by a main control circuit board.

It should be noted that, in this article, the terms "include", "comprise" or any other variant thereof are intended to encompass non-exclusive inclusion such that a process, method, article, or system that includes a series of elements includes not only those elements, but also other elements that are not explicitly listed, or also elements inherent to such a process, method, article, or system. Without further restrictions, the element defined by the statement "include a . . . " does not exclude the existence of other identical elements in the process, method, article or system that includes the element.

The above-mentioned serial numbers of embodiments of this application are for description only and do not represent the advantages and disadvantages of the embodiments.

From the above description of embodiments, it will be apparent to those skilled in the art that the methods of the above embodiments can be implemented by means of software plus the necessary universal hardware platform, of course also by means of hardware, but in many cases the former is better. Based on this understanding, the technical solution of this application can be embodied in the form of software products in essence or part that contributes to related technologies. The computer software product is stored in a storage medium (e.g., a ROM/RAM, disk, an optical disk) as described above and includes several instructions to cause a terminal device (which may be a mobile phone, a computer, a server, a network device, or the like.) to perform the methods described in various embodiments of this application.

The above are only optional embodiments of this application and do not thus limit the scope of the patent of this application. Any equivalent structure or equivalent process transformation made by utilizing the contents of the specification and the accompanying drawings of this application, or any directly or indirectly application to other related technical fields, is likewise included in the claimed scope of this application.

What is claimed is:

1. A method for detecting gate line defects, comprising following operations:

upon receiving a startup signal, controlling a display panel to enter a self-checking mode;

performing row scanning on the display panel according to a first preset frame rate, wherein the first preset frame rate is greater than a normal frame rate when the display panel works normally; and upon determining that the display panel is abnormal, issuing a prompt message;

wherein after the operation of upon determining that the display panel is abnormal, issuing a prompt message, the method further comprises:

controlling the display panel to close a self-checking interface and exit the self-checking mode.

2. The method for detecting gate line defects according to claim 1, wherein after the operation of performing row scanning on the display panel according to a first preset frame rate, the method further comprises:

upon determining that the display panel displays normally, controlling the display panel to normally start up; and controlling the display panel to perform row scanning according to the normal frame rate.

3. The method for detecting gate line defects according to claim 1, wherein after the operation of performing row scanning on the display panel according to a first preset frame rate, the method further comprises:

upon determining that the display panel displays normally, controlling the display panel to enter the self-checking mode again, and performing row scanning on the display panel according to a second preset frame rate, wherein the second preset frame rate is greater than the first preset frame rate; and upon determining that the display panel displays abnormally, issuing a prompt message and controlling the display panel to close the self-checking interface and exit the self-checking mode.

4. The method for detecting gate line defects according to claim 1, wherein the display panel comprises a main control circuit board and a timing controller, and before the operation of performing row scanning on the display panel according to a first preset frame rate, the method further comprises:

modifying a current pixel clock frequency of the main control circuit board;

obtaining the first preset frame rate according to the modified pixel clock frequency; and setting a frame rate of the timing controller to be the first preset frame rate.

5. The method for detecting gate line defects according to claim 4, wherein the display panel further comprises a gate driver connected to a plurality of gate lines, the operation of performing row scanning on the display panel according to a first preset frame rate comprises:

controlling the timing controller to perform row scanning on the plurality of gate lines in the display panel through the gate driver according to the first preset frame rate.

6. The method for detecting gate defect according to claim 5, wherein the display panel further comprises a source driver, a plurality of data lines and a plurality of thin film transistors, the source driver is connected to the timing controller and the plurality of data lines, gates of the thin film transistors are connected to the gate lines, sources of the thin film transistors are connected to the data lines, and the method further comprises:

during performing the row scanning on the display panel according to the first preset frame rate, controlling the timing controller to output data signals to the plurality of data lines of the display panel through the source driver to charge the thin film transistors of the display panel.

7. The method for detecting gate line defects according to claim 1, wherein the prompt message comprises a row number of a row where an abnormal gate line is located.

8. A display panel, comprising: a memory, a main control circuit board, and a gate line defect detection program stored in the memory and executable by the main control circuit board, wherein when the gate line defect detection program is executed by the main control circuit board, following operations of a method for detecting gate line defects are realized:

upon receiving a startup signal, controlling a display panel to enter a self-checking mode;

performing row scanning on the display panel according to a first preset frame rate, wherein the first preset frame rate is greater than a normal frame rate when the display panel works normally; and upon determining that the display panel is abnormal, issuing a prompt message.

9. The display panel according to claim 8, wherein after the operation of upon determining that the display panel is abnormal, issuing a prompt message, the method for detecting gate line defects further comprises:

controlling the display panel to close a self-checking interface and exit the self-checking mode.

10. The display panel according to claim 8, wherein after the operation of performing row scanning on the display panel according to a first preset frame rate, the method for detecting gate line defects further comprises:

upon determining that the display panel displays normally, controlling the display panel to normally start up; and controlling the display panel to perform row scanning according to the normal frame rate.

11. The display panel according to claim 8, wherein after the operation of performing row scanning on the display panel according to a first preset frame rate, the method for detecting gate line defects further comprises:

upon determining that the display panel displays normally, controlling the display panel to enter the self-checking mode again, and performing row scanning on the display panel according to a second preset frame rate, wherein the second preset frame rate is greater than the first preset frame rate; and upon determining that the display panel displays abnormally, issuing a prompt message and controlling the display panel to close the self-checking interface and exit the self-checking mode.

12. The display panel according to claim 8, wherein the display panel comprises a main control circuit board and a timing controller, and before the operation of performing row scanning on the display panel according to a first preset frame rate, the method for detecting gate line defects further comprises:

modifying a current pixel clock frequency of the main control circuit board;

obtaining the first preset frame rate according to the modified pixel clock frequency; and setting a frame rate of the timing controller to be the first preset frame rate.

13. The display panel according to claim 8, wherein the prompt message comprises a row number of a row where an abnormal gate line is located.

14. A non-transitory computer-readable storage medium, storing a control program of a method for detecting gate line defects, when the control program of the method for detecting gate line defects is executed by a main control circuit board, following operations of the method for detecting gate line defects are realized:

upon receiving a startup signal, controlling a display panel to enter a self-checking mode;

performing row scanning on the display panel according to a first preset frame rate, wherein the first preset frame rate is greater than a normal frame rate when the display panel works normally; and upon determining that the display panel is abnormal, issuing a prompt message.

15. The non-transitory computer-readable storage medium according to claim 14, wherein after the operation of upon determining that the display panel is abnormal, issuing a prompt message, the method for detecting gate line defects further comprises:

controlling the display panel to close a self-checking interface and exit the self-checking mode.

16. The non-transitory computer-readable storage medium according to claim 14, wherein, after the operation of performing row scanning on the display panel according to a first preset frame rate, the method for detecting gate line defects further comprises:

upon determining that the display panel displays normally, controlling the display panel to normally start up; and controlling the display panel to perform row scanning according to the normal frame rate.

17. The non-transitory computer-readable storage medium according to claim 14, wherein after the operation of performing row scanning on the display panel according to a first preset frame rate, the method for detecting gate line defects further comprises:

upon determining that the display panel displays normally, controlling the display panel to enter the self-checking mode again, and performing row scanning on the display panel according to a second preset frame rate, wherein the second preset frame rate is greater than the first preset frame rate; and upon determining that the display panel displays abnormally, issuing a prompt message and controlling the display panel to close the self-checking interface and exit the self-checking mode.

18. The non-transitory computer-readable storage medium according to claim 14, wherein the display panel comprises a main control circuit board and a timing controller, and before the operation of performing row scanning on the display panel according to a first preset frame rate, the method for detecting gate line defects further comprises:

modifying a current pixel clock frequency of the main control circuit board;

obtaining the first preset frame rate according to the modified pixel clock frequency; and setting a frame rate of the timing controller to be the first preset frame rate.

19. The non-transitory computer-readable storage medium according to claim 14, wherein the prompt message comprises a row number of a row where an abnormal gate line is located.

* * * * *